US005250756A

United States Patent [19]

Swift et al.

[11] Patent Number: 5,250,756

[45] Date of Patent: * Oct. 5, 1993

[54] PULTRUDED CONDUCTIVE PLASTIC CONNECTOR AND MANUFACTURING METHOD EMPLOYING LASER PROCESSING

[75] Inventors: Joseph A. Swift, Ontario; Thomas E. Orlowski, Fairport; Alan J. Werner, Jr., Rochester, all of N.Y.

[73] Assignee: Xerox Corporation, Stamford, Conn.

[ * ] Notice: The portion of the term of this patent subsequent to Aug. 18, 2009 has been disclaimed.

[21] Appl. No.: 795,435

[22] Filed: Nov. 21, 1991

[51] Int. Cl.[5] ..... H01B 7/00

[52] U.S. Cl. ..... 174/119 R; 174/110 R; 174/119 C; 310/251; 38/114; 355/219; 361/225; 439/291; 439/930

[58] Field of Search ..... 174/119 R, 119 C, 110 R; 338/66, 114; 361/225; 355/203, 219; 310/251; 439/290, 291, 930

[56] References Cited

U.S. PATENT DOCUMENTS

| | | | |
|---|---|---|---|
| 3,886,386 | 5/1975 | Hillig | 310/248 |
| 4,090,984 | 5/1978 | Lin et al. | 252/511 |
| 4,106,869 | 8/1978 | Buchheit | 355/3 R |
| 4,139,119 | 4/1979 | Buchheit | 324/32 |
| 4,206,958 | 6/1980 | Hall et al. | 439/291 |
| 4,306,169 | 12/1981 | Diepers | 310/248 |
| 4,336,565 | 6/1982 | Murray et al. | 361/225 |
| 4,358,699 | 11/1982 | Wilsdorf | 310/251 |
| 4,369,423 | 1/1983 | Holtzberg | 338/66 |
| 4,455,078 | 6/1984 | Mukai et al. | 355/3 CH |
| 4,569,583 | 2/1986 | Robson et al. | 355/14 CH |
| 4,741,873 | 5/1988 | Fischer et al. | 264/25 |
| 4,748,436 | 5/1988 | Kanamori et al. | 338/214 |
| 4,761,709 | 8/1988 | Ewing et al. | 361/225 |
| 4,801,967 | 1/1989 | Snelling | 355/3 CH |
| 4,818,438 | 4/1989 | Wiley | 252/511 |
| 4,945,342 | 7/1990 | Steinemann | 174/113 R |
| 4,970,553 | 11/1990 | Orlowski et al. | 174/258 X |
| 5,010,441 | 4/1991 | Fox et al. | 361/221 |
| 5,060,016 | 10/1991 | Wanou et al. | 355/219 |
| 5,139,862 | 8/1992 | Swift et al. | 428/294 |
| 5,142,326 | 8/1992 | Iwata et al. | 355/208 |

FOREIGN PATENT DOCUMENTS

| | | |
|---|---|---|
| 095254 | 11/1983 | European Pat. Off. . |
| 369772 | 5/1990 | European Pat. Off. . |
| 370818 | 5/1990 | European Pat. Off. . |

*Primary Examiner*—Morris H. Nimmo
*Attorney, Agent, or Firm*—Oliff & Berridge

[57] ABSTRACT

A high voltage connector is formed of a composite pultruded member that has an inner core including a plurality of high resistance electroconductive strands carried in a resin binder. The inner core is surrounded by an outer nonconductive shell, and extends from a laser cut end of the outer shell to a contact face. During formation of the contact using laser techniques, portions of the outer shell are removed to expose the inner core, the resin binder of the inner core may be removed, and the strands of the inner core may be fibrillated and patterned as desired. In one embodiment, the resistance of the strands of the inner core of the high voltage connector provide a load resistor for a circuit to which the connector may be connected.

15 Claims, 3 Drawing Sheets

PULTRUDED CONDUCTIVE PLASTIC CONNECTOR AND MANUFACTURING METHOD EMPLOYING LASER PROCESSING

FIELD OF THE INVENTION

This invention relates to improvements in electrical connectors, and more particularly to improvements in high voltage connectors, and still more particularly to high voltage connectors made of composite pultruded members, and to methods for making same.

BACKGROUND OF THE INVENTION

The invention has wide applications; however, as will become apparent, a preferred embodiment of the invention is particularly suitable for applications in electrostatographic reproducing machines. In a typical electrostatographic reproducing machine, a photoconductive insulating surface, often in the form of a moving belt, is uniformly charged and exposed to a light image from an original document. The light image causes the exposed or background areas to become discharged, and creates an electrostatic latent image on the surface corresponding to the image contained within the original document. Alternatively, a light beam such as a laser beam may be modulated and used to selectively discharge portions of the photoconductive surface to record the desired information thereon. The electrostatic latent image is made visible by developing the image with a developer powder, referred to in the art as toner, which may be subsequently transferred to a support surface such as paper to which it may be permanently affixed by the application of heat and/or pressure.

In order to minimize maintenance costs by permitting the operator to replace worn out or exhausted processing units in electrostatographic apparatus, it has been suggested to incorporate one or more processing units of the apparatus in disposable or removable cartridges or units. In this way the operator can readily remove each cartridge when its operational life has been exhausted and insert a new cartridge. In addition, it also provides the advantage of enabling less expensive functional features, such as the photoreceptor drum in a conventional copier. Typically, these processing cartridges include an imaging member such as a rotatable drum or an endless belt together with one or more of a charge corotron, a developing device and cleaning device.

In these applications, it is generally necessary to distribute power, high voltage and/or logic signals between the main frame of the machine and the removable processing unit or cartridge. Traditionally, this has taken the form of utilizing conventional wires and wiring harnesses in each machine to distribute power and logic signals between the main frame of the machine and the removable processing unit. For example, conventional plug and socket arrangements have been used which can be either manually connected or joined automatically on insertion of the unit into the main frame. This automatic joining requires precision positioning and alignment of the unit on insertion with very low tolerance for misalignment error. Typically, locating members such as pins or rails are used to insure proper positioning, all of which can negatively impact upon not only a large number of parts required to build the machine, but also upon the overall manufacturing cost. In addition, conventional wires and wiring harnesses are flexible and therefore, do not lend themselves to automated assembly such as with the use of robots leading further to increased manufacturing costs.

Presently, high voltage connectors are routinely manufactured by insert molding a preformed metal pin or socket into an insulating plastic housing. Often a suitable wire is simultaneously insert molded within the same connector housing to produce a complete connector assembly. There are, however, at least three to five separate steps to the present manufacturing process of conventional high voltage connectors.

While certain other electrical contacts have been proposed, they suffer certain deficiencies. For example, the use of two conventional metal plate contacts such as two spring biased metal tabs one on each of the main frame and the removable unit in addition to requiring the precision positioning and alignment discussed above can be rendered unreliable after only a short period of use in the hostile machine environment by having the contacting surfaces contaminated by dirt, toner, paper fibers, or other debris. Furthermore, such metal contacts tend to oxidize thereby forming an insulating layer on the contact surface and degrading further the reliability and performance of the contact.

PRIOR PATENTS

U.S. Pat. No. 4,748,436 to Kanamori et al. describes a noise prevention high voltage resistance wire including a non-metallic reinforcing core wire, a conductive composite including carbon conductive material and formed so as to cover said reinforcing core wire, and at least one insulating layer formed so as to cover said conductive composite. The conductive composite includes gaseous phase growth carbon fiber. The insulating coating layer is made of a heat resistant, durable rubber material.

U.S. Pat. No. 4,818,438 to Wiley describes a composition useful in the manufacture of automobile ignition cables and other elongated conductors. The composition contains elemental (as compressed powder) carbon and a polymeric matrix or binder. A ground calcined, coal-based coke is employed as a conductive additive or pigment. In one embodiment, the conductor includes graphite impregnated fiberglass conductor elements. A braid material of rayon, cotton, or the like is woven around the elements to hold said elements together. A covering or composition surrounds the "core", preferably of a high temperature resistant electrically conductive layer. Optionally, an overlying conductive covering or coating formed of a material which includes a highly conductive pigment is provided.

U.S. Pat. No. 4,090,984 to Lin et al. describes a semiconductive coating for glass fibers comprising polyacrylate emulsion, a conductive carbon black dispersion and a thixotropic gelling agent.

SUMMARY OF THE INVENTION

In light of the above, it is, therefore, an object of the invention to provide an improved high voltage connector made from a composite pultruded member having a conductive core and a nonconductive shell which is made by using a laser to cut trim and fibrillate the ends.

It is another object of the invention to provide a high voltage connector of the type described which can be made of high resistance to provide a load or transient suppression resistor for the circuit with which the connector may be used.

It is still another object of the invention to provide a high voltage connector of the type described that can be economically manufactured, with fewer manufacturing steps than conventional high voltage connectors.

It is yet another object of the invention to provide a high voltage connector of the type described that can be manufactured with readily available laser equipment and process technologies.

These and other objects, features and advantages of the invention will be apparent to those skilled in the art from the following detailed description of the invention, when read in conjunction with the accompanying drawings and appended claims.

In a broad aspect, this invention presents a high voltage connector that is formed of a composite pultruded member having an inner core including a plurality of high resistance electroconductive strands carried in a resin binder. The inner core is surrounded by an outer nonconductive shell, and extends from a laser cut end of the outer shell to a contact face. During formation of the contact using laser techniques, portions of the outer shell are removed to expose the inner core, the resin binder of the inner core may be removed, and the strands of the inner core may be fibrillated and patterned, as desired.

In one embodiment, the resistance of the strands of the inner core of the high voltage connector provide a load resistor for a circuit to which the connector may be connected.

BRIEF DESCRIPTION OF THE DRAWINGS

A preferred embodiment of the invention is illustrated in the accompanying drawings, in which.

DETAILED DESCRIPTION OF THE PREFERRED EMBODIMENTS

In accordance with a preferred embodiment of the invention, a new class of high voltage connectors is presented. The connectors use a pultrusion of a composite configuration which contains electroconductive centrally located fiberous strands, each embedded in a polymeric resin. Laser processing is used to strip the resin from the conductive strands on the front face of the connector, exposing them to make contact. If desired, the high resistance of the fibers can serve as a load or noise damping element for the circuit to which connection is to be made, thereby providing, for example, a combination of a ballast resistor and a high voltage connector. If desired, the connector can be made in a relatively long, rigid length, for example on the order of up to about one foot, and for which a structural supporting connector need be provided only at one end.

Figure 1:
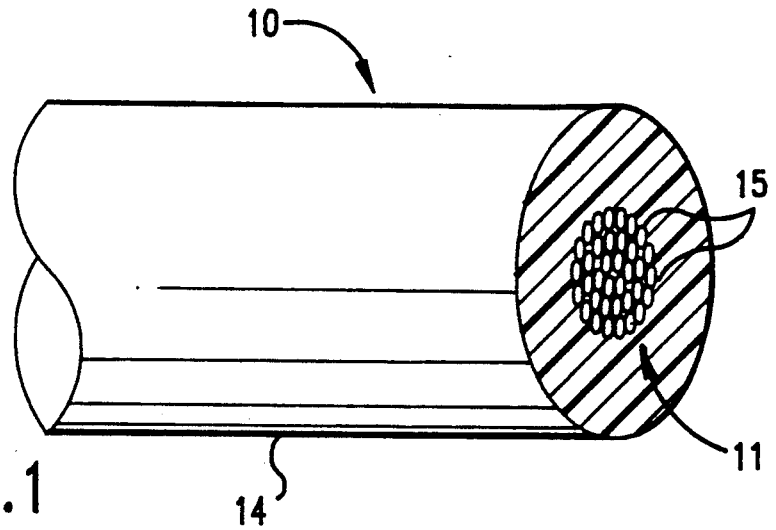
FIGS. 1-3 are perspective views of a portion of a connector in various stages of its manufacture.
Figure 3:
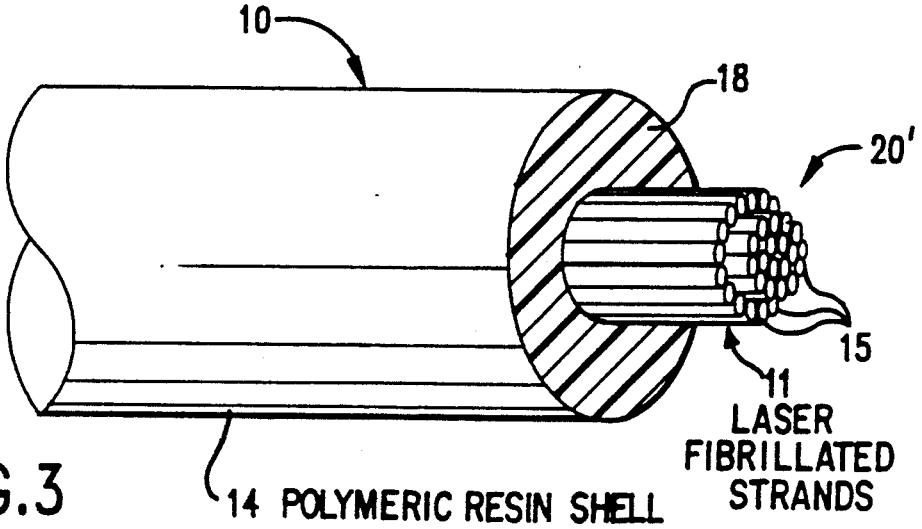

More specifically, in accordance with the present invention, an improved high voltage contact is provided that is of improved reliability, is of low cost, and is easily manufacturable. These advantages are enabled through the use of a manufacturing process known generally as a pultrusion process, with the subsequent fibrillation of at least one end of that piece part produced by pultrusion. With reference now to FIG. 1, the connector is formed of a composite pultruded composition 10, which includes an electroconductive, fiberous core 11 and an outer, insulating shell 14 surrounding the conductive core 11. The conductive core 11 is formed of a plurality of, finer diameter, high resistance electroconductive fibers 15 which are embedded in a resin material. The outer shell 14 is nonconductive, and is trimmed at one end by mechanical machining or laser machining techniques to create a contact face 20, extended beyond the trimmed end 18, as shown in FIG. 3. Preferably, carbon fiber are the fibers of choice for this connector application.

Such carbon fiber based pultrusions are a subcategory of high performance conductive composite plastics, and comprise one or more types of continuous, conductive reinforcing filaments in a binder polymer. They provide a convenient way to handle, process and use fine diameter, carbon fibers without the problems typically encountered with free conductive fibers.

The pultrusion process generally consists of pulling continuous lengths of fibers first through a resin bath or impregnator, then into a preforming fixture where the resulting section is at least partially shaped and excess resin and/or air are removed. The section is then pulled into heated dies where it is continuously cured. For a detailed discussion of pultrusion technology, reference is directed to "Handbook of Pultrusion Technology" by Raymond W. Meyer, first published in 1985 by Chapman and Hall, New York.

More specifically, in the practice of the invention, conductive carbon fibers are submersed in a polymer bath and drawn through a die opening of suitable shape and elevated temperature to produce a solid piece having dimensions and shapes of that controlled by the die. The solid piece can then be cut, shaped, or machined. As a result, a structure can be achieved that has thousands of conductive fiber elements contained within the polymer matrix, the ends of the fiber elements being exposed to provide suitable electrical contacts. The very large contact redundancy enabled by the very large number of individual electroconducting fibers enables a substantial improvement in the reliability of these devices.

Since the plurality of small diameter conductive fibers are pulled through the polymer bath and heated die as a continuous length, the shaped member can be formed with the fibers being continuous from one end of the member to the other. Accordingly, the pultruded composite may be formed in a continuous length during the pultrusion process, then cut to any suitable dimension, with a very large number of filamentary electrical contacts provided at each end and continuously connected therebetween. Such pultruded composite members may have either one or both of its ends subsequently fibrillated.

Any suitable electroconductive fiber having a high resistance may be used in the practice of the invention. However, carbon fibers are particularly well suited as preferred fiber because they are chemically and environmentally inert, possess high strength and stiffness, can be tailored to a wide range of resistivities, and exhibit a negative coefficient of thermal resistivity. The conductive fibers can be easily formed to have a DC volume resistivity of from about $1\times10^6$ Ω.cm to about $1\times10^8$ Ω.cm and preferably from about $5\times10^7$ Ω.cm to about $1\times10^8$ Ω.cm.

It must be noted that the overall resistance of the completed pultrusion is determined by a number of factors such as the number of the fibers in the pultrusion as well as the resistance of the fibers. Therefore some degree of tailoring the resistance can be accomplished by adjusting the admix of fibers of differing resistances.

In addition, the individual conductive fibers 15 can be made circular in cross section with a diameter generally in the order of from about 4 micrometers to about 50 and preferably from about 7 micrometers to 10 micrometers. This provides a very high degree of fiberous contact redundancy in a small cross sectional area of the composite's core. Thus, used herein as contact materials, the electroconductive fibers provide a multiple redundancy of individual contact points, for example, in the range between about $0.05\times10^5$ and $1\times10^6$ contacts/cm$^2$, any one, or more of which can serve as an effective contact. The availability of a very large number of fiberous contacts within a small contact zone is believed to enable ultrahigh contact reliability. Moreover, for instance, in electrostatic reproducing machines, such pultrusion based contacts are also are likely to minimize harmful contamination within the machines.

The fiber rich electroconductive core element 11 may be, in accordance with a preferred embodiment of the invention, solid rods or tubes having diameters ranging from about 0.050 to 0.375 inches with roughly a circular shape, as shown in the Figures. The electroconductive fibers 15 account for approximately 10 to 90 percent of the total cross sectional area of the central element 11. Typical fibers may be, for example continuous strand carbon fiber, resistive carbon fiber, metal plated carbon fiber, metal plated fiberglass fiber, stainless steel fiber, and the like. The fibers 15 are carried in a suitable resin binder to form the core element 15 of the composite pultrusion 10. A particularly preferred class of fibers that may be used are those fibers that are obtained from controlled heat treatment processing to yield complete or partial carbonization of polyacrylonitrile (PAN) precursor fibers. By carefully controlling the temperature of carbonization within certain limits, precise electrical resistivities for the carbonized carbon fibers may be obtained. The carbon fibers from polyacrylonitrile (PAN) precursor are commercially produced by the Stackpole Company, Celion Carbon Fibers, Inc., division of BASF and others in yarn bundles of 1,000 to 160,000 filaments. The yarn bundles are carbonized in a two-stage process. The first stage involves stabilizing the PAN fibers at temperatures of the order of 300° C. in an oxygen atmosphere to produce preox-stabilized PAN fibers. The second stage involves carbonization of the fibers at elevated temperatures in an inert atmosphere, such as an atmosphere containing nitrogen. The DC electrical resistivity of the resulting fibers is controlled by the selection of the temperature of carbonization. For example, carbon fibers having an electrical resistivity of from about $10^3$ Ω.cm to $10^6$ Ω.cm are obtained if the carbonization temperature is controlled in the range of from about 750° C. to about 1150° C. For further reference to the processes that may be employed in making these carbonized fibers attention is directed to U.S. Pat. No. 4,761,709 to Ewing et al and the literature sources cited therein at column 8.

As mentioned, the fibers 15 are enclosed in a suitable resin binder. The resin binder should be of a material that will volatilize rapidly and cleanly upon direct exposure to the laser beam during laser processing below described. Thermal plastic polymers such as low molecular weight polyethylene, polypropylene, polystyrene, polyvinylchloride, nylon, polyester, polyimide, polyphenelyene sulfide, poly ether ether ketone (PEEK), polyimideamide, polyetherimide, and polyurethane may be particularly advantageously employed. Alternately, thermal setting polymers such as vinyl ester, polyester, and epoxy may also be employed in the practice of this invention. Naturally, the polymeric resin chosen for the inner core region 11 can be the same as that chosen for the outer region 14. In the case where different polymeric resins are preferred for the inner and outer regions, it may be preferred to pultrude one of the elements (i.e. the core element) first then feed this as a solid composite continuously into a second pultrusion process step to form the outer region. This two step pultrusion-pultrusion process may be particularly useful to produce the shapes illustrated in FIGS. 1-3.

The shell region 14 is nonconductive, and has a sufficiently high dielectric breakdown strength to support high AC and DC voltages, for example in the range of between 1 to 25 kilovolts. The shell portion 14 comprises a continuous strand nonconductive fiber, such as fiberglass, polyester, polyimide, rayon, polypropylene, nylon, acrylic, ceramic, and the like, and a suitable resin, such as polyester, vinyl ester, epoxy, polycarbonate, nylon, polyphenelyene sulfide, poly ether ether ketone (PEEK), and the like.

A laser (not shown) can be used to cut individual components for use as an electrical contact in accordance with the invention. Thus, a suitable protrusion can be cut by laser techniques to form a contact of desired length from the longer pultrusion length, and at the same time, both severed ends can be fibrillated to provide a high redundancy fiber contact member at the face 20 to contact external circuitry (not shown). Any suitable laser can be used which will be absorbed by the material of the shell 14, so that it will be volatilized in the regions to be removed and of the core 11, so that the resin will volatize appropriately thereby fibrillating, or partially fibrillating the electrical contact element. Examples of specific lasers which may be used include a carbon dioxide laser, a carbon monoxide laser, a YAG laser, or an argon ion laser. The carbon dioxide laser is particularly suited for this application, since it is the highly reliable, suitable for polymer matrix absorption, and is economical in large scale manufacturing. Additionally, other mechanical resin removal techniques which yield a similar surface structure may also be used as long as a fiber rich surface structure is maintained.

Figure 5:
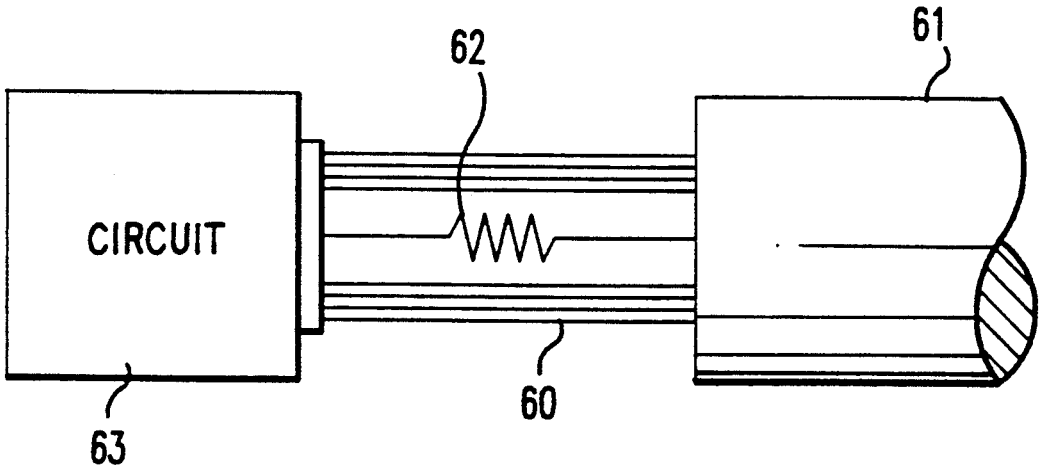
FIG. 5 is an exemplary drawing showing the fibers of the connector being used as a load resistor. In the various figures, like reference numerals are used to denote like or similar parts. Moreover, in the drawings, various sizes and dimensions of the parts have been exaggerated or distorted for clarity of illustration or ease of description.

As mentioned, a preferred embodiment of the invention provides a high resistance, high voltage contact. This contact may be used in many applications, examples of which are as a high voltage input contact for an electrostatic voltmeter, useful, for instance, to continuously measure the electrostatic charge on a moving photoreceptive surface (not shown). Another example in which the contact may be used is as a connector for a high voltage corotron. If desired, as shown in FIG. 5, the high resistance of the conductors 60 of the fiber structure 61 can serve as a load resistor, shown functionally as a resistor 62 in the drawing, for a circuit 63, thereby providing, for example, a combination of a ballast resistor and a high voltage connector in conjunction with an external circuit to which the contact establishes electrical connection. The connector can be made to have a relatively long length, for example on the order of up to about one foot, or more, and enables a rigid long structural connector which need be supported only at one end.

Figure 2:
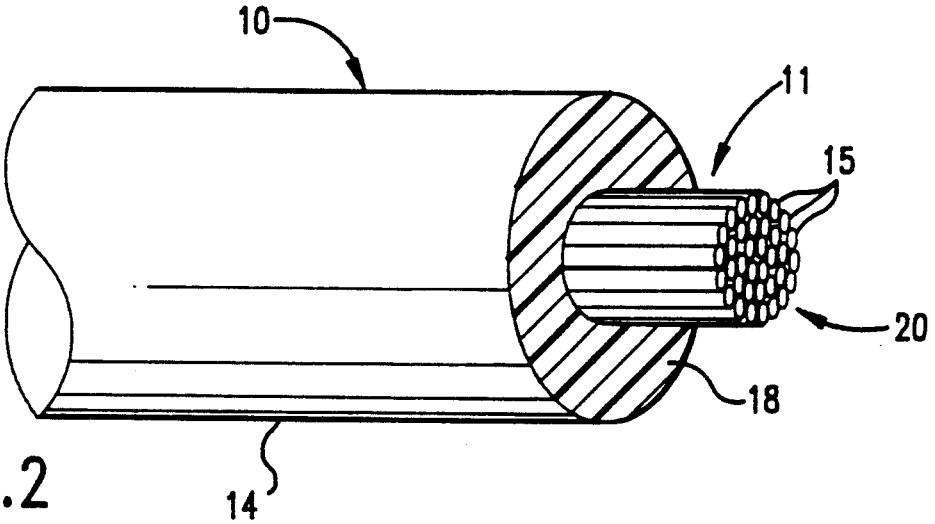

The method for making the high voltage connector, in accordance with a preferred embodiment of the invention, is illustrated in FIGS. 1–3. With reference first to FIG. 1, a configuration of a composite pultrusion 10 is shown that is commercially available from the Polygon Corporation. As mentioned, the composite pultrusion has a central core 11 of strands 15 in a suitable resin binder. The shell region 14 surrounds the central core element 11 while the central core 11 makes up about 10 to 90 percent of the total cross sectional area of the pultrusion.

Processing of the composite pultrusion 10 into high voltage connectors is efficiently performed using either mechanical machining or laser techniques. In accordance with such preferred laser techniques, a portion of the outer shell 14 is removed, leaving a portion of the inner core 11 extending a desired distance from the cut outer shell end, as shown in FIG. 2.

Thus, a composite pultrusion after laser removal of the shell region is illustrated, in a manner similar to well known laser wire stripping techniques. It is important to note that the thermal decomposition properties (i.e. vaporization temperature) of the filler fiber and perhaps resin system used in the outer shell should be preferably selected to be significantly less thermally stable than the carbon fiber (and perhaps the resin) of the center section 11.

Finally, as shown in FIG. 3, the resin surrounding the individual carbon fibers 15 of the center core 11 is trimmed and removed, and the end portions of the fibers 15 of the center core 11 which extend between the cut end 18 of the shell 14 and the end face 20 are fibrillated by laser techniques. For example, a focused $CO^2$ laser can be used to cut the pultrusion 10 and simultaneously to volatilize the binder resin in a controlled manner a sufficient distance back from the cut to produce in one step a distributed filament contact. The length of exposed carbon fiber can be controlled by the laser power and cut rate. During the laser processing the end portion can also be machined to a desired final shape, as denoted by numeral 20' in FIG. 3. All of the laser processing steps can be accomplished during a single laser operation, if desired. The stepwise configuration depicted in FIG. 3 is only one such preferred end configuration. A conical, continually tapered end configuration can be obtained by appropriately orienting the laser in an angled attitude to the pultrusion being cut. Other end configurations are also possible and may be preferred depending upon specific application requirements.

In view of the above, it will be appreciated that through the use of the composite pultrusions and laser processing techniques, the previously required three to five step manufacturing process for traditional connectors has been reduced to only one or two, resulting in a less costly connector. Further, these solid plastic pultruded connectors are likely to lend well to applications where the high voltage connector is incorporated as an integral part of a plastic housed device, for instance as is required in corotron applications, thereby offering an opportunity to reduce the costs of these devices, as well. Thus the highly stable carbon fiber fillers coupled with selectable resistivities are envisioned as enabling unique, highly reliable, low cost, multifunctional, high voltage connectors.

Figure 4:
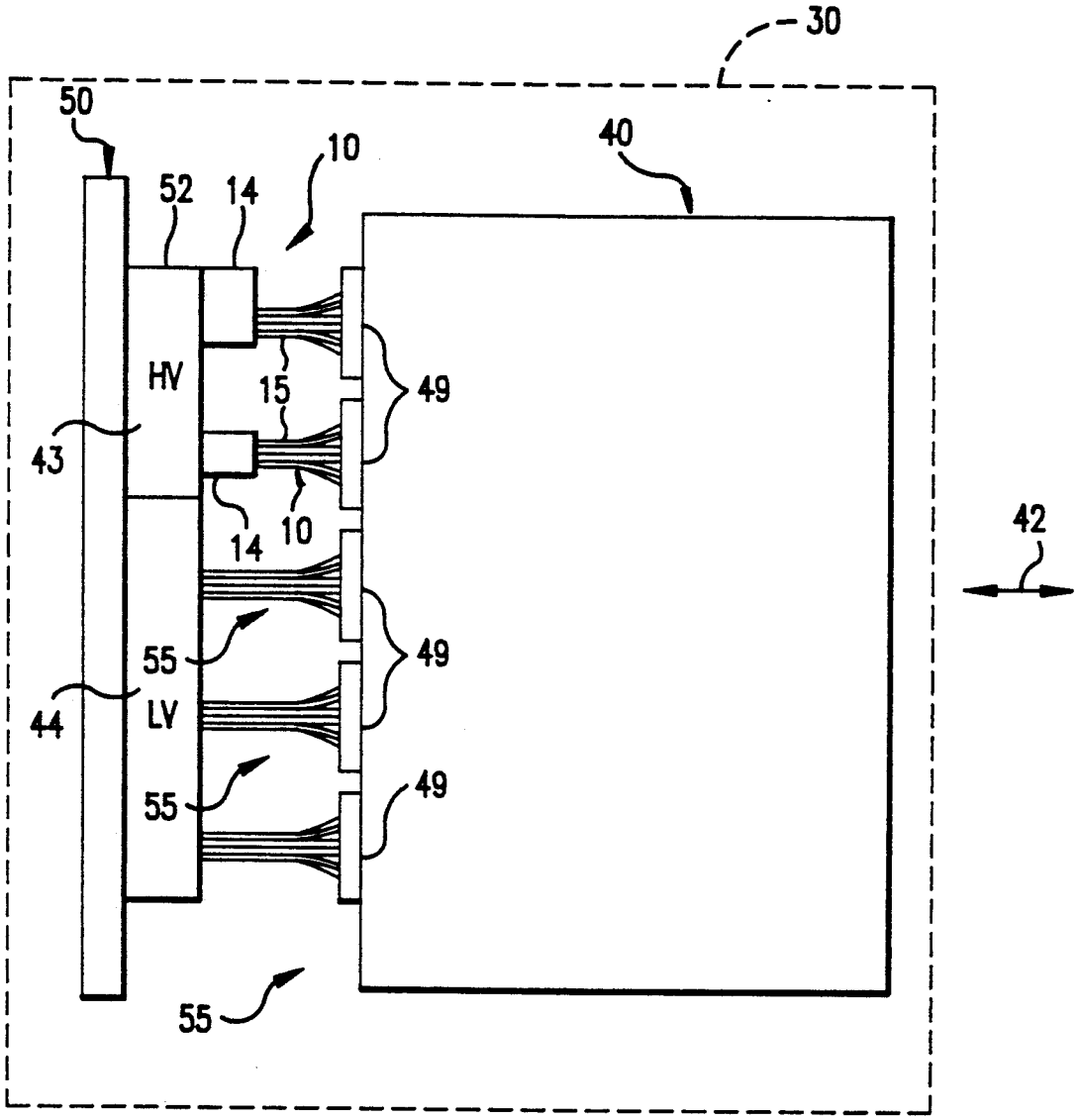
FIG. 4 is a side view of a plurality of both high voltage and low voltage connections between a removable unit and a main frame of an electrostatographic machine showing interconnection therebetween by pultrusion connections in accordance with one embodiment of the invention.

FIG. 4 illustrates one manner in which connections in accordance with one embodiment of the invention may be used in an electrostatographic machine 30 wherein an electrical connection is made between contacting elements on a removable unit 40 and a main frame 50 in the direction substantially parallel to the direction of insertion (see the arrow 42) of the removable unit 40 into the main frame 50. In addition, in FIG. 4, there are illustrated two high voltage electrical connections 43 and three low voltage electrical connections 44. It is worthwhile to note that with respect to all the connections that the landing pads 49 are present on the removable unit 40, whereas the conductive brush elements of the electrical connection are present on a mounting block 52 on a portion of the main frame 50. Alternatively, the brushes can be mounted on the removable unit 40 and the landing pads mounted on the main frame 50, it being noted that the selection of mounting location is independent of high or low voltage. Furthermore, the direction of insertion may be reversed. However, the lengths of fibers illustrated as 15 and 55 for the respective high and low voltage elements, are preferably very short in the range of from 0.001 to 0.025 inches.

The surface of the landing pads 49 can be molded, or shaped into a part or bracket in either the main frame 50 or the removable unit 49. For example, providing an etched conductive pattern in a printing wiring board or conductive pattern on plastic may be very effective in providing the electrical contact at a minimum of expense. Alternately, the landing pads 49 may be short lengths of the same composite pultrusions as illustrated in FIG. 1 or 2. In this configuration they represent the best case for contact reliability.

In the embodiment shown in FIG. 4, each of the high voltage electrical connectors 14 corresponds to a composite pultrusion, such as illustrated in FIG. 3. Each can be mounted, as shown, by a supporting connection (not shown) at one end to the mounting block 52, and due to the rigidity of the center portion 11 and strength of the shell portion 14, the structure will provide overall structural rigidity, insulation, and form and fit functions typically associated with the housing of traditional connectors. At the same time, in addition, the highly redundant contact to the landing pads provided by the fibers 15 provides reliable contact. Connection (not shown) to the fibers 15 may be made inside the block 52 by any convenient technique. For example, the core 11 may be exposed and fibrillated in a manner similar to the exposed core 11 shown, to contact an interior contact or landing pad (not shown).

As shown, the high voltage connectors 10 may be used in conjunction with other connectors of conventional design. Thus, as shown, the low voltage connectors 55 are of brush configuration, for example, as described in U.S. Pat. No. 5,177,529, assigned to the assignee hereof.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A high voltage connector for making electrical connection to a surface, comprising:

a composite pultruded member including:

a plurality of high resistance electroconductive strands;

a resin material in which said plurality of high resistance electroconductive strands are embedded;

a nonconductive shell surrounding said embedded high resistance electroconductive strands;

said composite pultruded member having exposed conductive strands on a front face of the connector for making point contacts to the surface when the strands are brought into contact therewith;

said resin material and said shell providing rigid support for said plurality of high resistance electroconductive strands, to maintain contact of said strands with said surface when said strands are brought into contact therewith; and said nonconductive shell having a laser cut end with said exposed conductive strands extending between said laser cut end and said front face, wherein said exposed conductive strands are fibrillated between said laser cut end and said front face to form a highly dense area of point contacts.

2. The high voltage connector of claim 1, wherein said laser fibrillated strands are free of said resin between said cut end and said front face.

3. The high voltage connector of claim 1 wherein the high resistance of the fiber is capable of providing a load resistor for a circuit to which the connector may be connected.

4. The high voltage connector of claim 1 wherein said connector is of length of between about 0.1 inch and 12 inches.

5. The high voltage connector of claim 1 further comprising means for supporting said connector at only one end.

6. The high voltage connector of claim 1 wherein said plurality of high resistance electroconductive strands are configured into solid rods having outer diameters in the range between about 0.050 and about 0.375 inches.

7. The high voltage connector of claim 6 wherein said solid rods are of substantially circular cross sectional shape.

8. The high voltage connector of claim 7 wherein said solid rods occupy between about 10 to 90 percent of the total cross sectional area of the connector.

9. The high voltage connector of claim 1 wherein said shell region has a dielectric breakdown voltage between about 10 kilovolts and about 25 kilovolts.

10. The high voltage connector of claim 1 wherein said shell portion comprises a continuous strand nonconductive fiber and a resin.

11. The high voltage connector of claim 10 wherein said nonconductive fiber of said shell is of material selected from the group consisting of fiberglass, polyester, polyimide, nylon, polypropylene, rayon, acrylic, and ceramic, and said resin of said shell is a material selected from the group consisting of polyethylene, polypropylene, polystyrene, polyvinylchloride, nylon, polyimide, polyphenelyene sulfide, poly ether ether ketone (PEEK), polyimideamide, polyetherimide, polyurethane polyester, vinyl ester, epoxy, and polycarbonate.

12. The high voltage connector of claim 1 wherein said plurality of high resistance electroconductive strands are of a material selected from the group of continuous strand carbon fibers, resistive carbon fibers, metal plated carbon fibers, metal plated fiberglass fibers, and stainless steel fibers.

13. An electrostatic reproducing machine for reproducing an image of an original document, comprising:

a main frame fixed within said machine and containing electrical conductors used in the reproduction of said image;

a removable unit movable relative to said main frame and containing electrical conductors used in the reproduction of said image; and a high voltage connector providing electrical connection between the electrical conductors of said main frame and said removable unit, said high voltage connector comprising:

a composite pultruded member including:

a plurality of high resistance electroconductive strands;

a resin material in which said plurality of high resistance electroconductive strands are embedded;

a nonconductive shell surrounding said embedded high resistance electroconductive strands;

said composite pultruded member having exposed conductive strands on a front face of the connector for making point contacts to a surface when the strands are brought into contact therewith; and said resin material and said shell providing rigid support for said plurality of high resistance electroconductive strands, to maintain contact of said strands with said surface when said strands are brought into contact therewith, said surface and said strands being electrically connected to said electrical conductors of said main frame and said removable unit, said nonconductive shell having a laser cut end with said exposed conductive strands extending between said laser cut end and said front face, wherein said exposed conductive strands are fibrillated between said cut end and said front face to form a highly dense area of point contacts.

14. The electrostatic reproducing machine of claim 13, wherein said surface is electrically connected to said electrical conductors of said main frame, and said strands are connected to said electrical conductors of said removable unit.

15. The electrostatic reproducing machine of claim 13, wherein said surface is electrically connected to said electrical conductors of said removable unit, and said strands are connected to said electrical conductors of said main frame.

* * * * *